US007662076B1

(12) United States Patent
Ho

(10) Patent No.: US 7,662,076 B1
(45) Date of Patent: Feb. 16, 2010

(54) EXERCISING MACHINE

(76) Inventor: Wei-Teh Ho, P.O. Box 24-108, Taipei (TW)

( * ) Notice: Subject to any disclaimer, the term of this patent is extended or adjusted under 35 U.S.C. 154(b) by 0 days.

(21) Appl. No.: 12/317,676

(22) Filed: Dec. 29, 2008

(51) Int. Cl.
*A63B 21/04* (2006.01)
*A63B 69/18* (2006.01)

(52) U.S. Cl. ..... 482/130; 482/70; 482/135

(58) Field of Classification Search ..... 482/70, 482/72, 92, 95, 96, 121, 129, 130, 132, 135, 482/140
See application file for complete search history.

(56) References Cited

U.S. PATENT DOCUMENTS

| | | | | | |
|---|---|---|---|---|---|
| 1,984,165 | A * | 12/1934 | Tolchin | 482/95 |
| 2,720,396 | A * | 10/1955 | Pfaus | 482/130 |
| 2,724,592 | A * | 11/1955 | Pfaus | 482/130 |
| 3,421,760 | A * | 1/1969 | Freeman, Jr. | 482/80 |
| 3,589,720 | A * | 6/1971 | Agamian | 482/114 |
| 4,709,918 | A * | 12/1987 | Grinblat | 482/70 |
| 5,080,353 | A * | 1/1992 | Tench | 482/130 |
| 5,279,530 | A * | 1/1994 | Hess | 482/70 |
| 5,342,264 | A * | 8/1994 | Gordon | 482/70 |
| 5,499,958 | A * | 3/1996 | Hess | 482/79 |
| 5,518,483 | A * | 5/1996 | Oswald | 482/131 |
| 6,071,217 | A * | 6/2000 | Barnett | 482/121 |
| 6,238,322 | B1 * | 5/2001 | Hsu | 482/96 |
| 6,302,829 | B1 * | 10/2001 | Schmidt | 482/70 |
| 6,440,045 | B1 * | 8/2002 | Gaston | 482/140 |
| 6,514,180 | B1 * | 2/2003 | Rawls | 482/70 |
| 6,981,932 | B1 * | 1/2006 | Huang et al. | 482/72 |
| 7,232,404 | B2 * | 6/2007 | Nelson | 482/140 |
| 7,455,633 | B2 * | 11/2008 | Brown et al. | 482/142 |
| 7,485,079 | B2 * | 2/2009 | Brown et al. | 482/140 |
| 2001/0036885 | A1 * | 11/2001 | Castellot et al. | 482/79 |
| 2004/0167000 | A1 * | 8/2004 | Schwarz | 482/123 |
| 2009/0098983 | A1 * | 4/2009 | Hoffman | 482/70 |

* cited by examiner

*Primary Examiner*—Loan H Thanh
*Assistant Examiner*—Victor K Hwang

(57) ABSTRACT

An exercising machine includes a front foot member, a rear foot member, an upright mounted on the front foot member to support a handlebar, two sliding tubes connected in parallel between the upright and the rear foot member, two slide members respectively coupled to the sliding tubes by a respective set of sliding wheels to hold a respective footplate for movement along the slide members, two elastic pull straps respectively inserted through the sliding tubes and connected between the upright and the slide members, and two tension adjusters for adjusting the tension of the elastic pull strap.

2 Claims, 7 Drawing Sheets

EXERCISING MACHINE

BACKGROUND OF THE INVENTION

1. Field of the Invention

The present invention relates to physical training machines and more particularly, to a simple structure of exercising machine, which is practical for exercising the muscles of the hands, legs, abdomen and back of the user's body.

2. Description of the Related Art

Following improvement in living standards, people do more care about their health and in consequence, exercising apparatuses have become quite popular. Conventional exercising machines are designed for exercising a specific part of the body. There are also many exercising machines practical for exercising different parts of the body. However, these conventional multipurpose exercising machines are commonly heavy and expensive.

SUMMARY OF THE INVENTION

The present invention has been accomplished under the circumstances in view. It is one object of the present invention to provide an exercising machine, which is effective for exercising the muscles of the hands, legs, abdomen and back of the user's body. It is another object of the present invention to provide an exercising machine, which is conveniently adjustable to fit different exercise amount requirements.

To achieve these and other objects of the present invention, an exercising machine comprises a An exercising machine includes a front foot member, a rear foot member, an upright mounted on the front foot member to support a handlebar, two sliding tubes connected in parallel between the upright and the rear foot member, two slide members respectively coupled to the sliding tubes by a respective set of sliding wheels to hold a respective footplate for movement along the slide members, and two elastic pull straps respectively inserted through the sliding tubes and connected between the upright and the slide members.

Further, two tension adjusters are bilaterally mounted on the upright for adjusting the tension of the elastic pull strap.

DETAILED DESCRIPTION OF THE INVENTION

Figure 1:
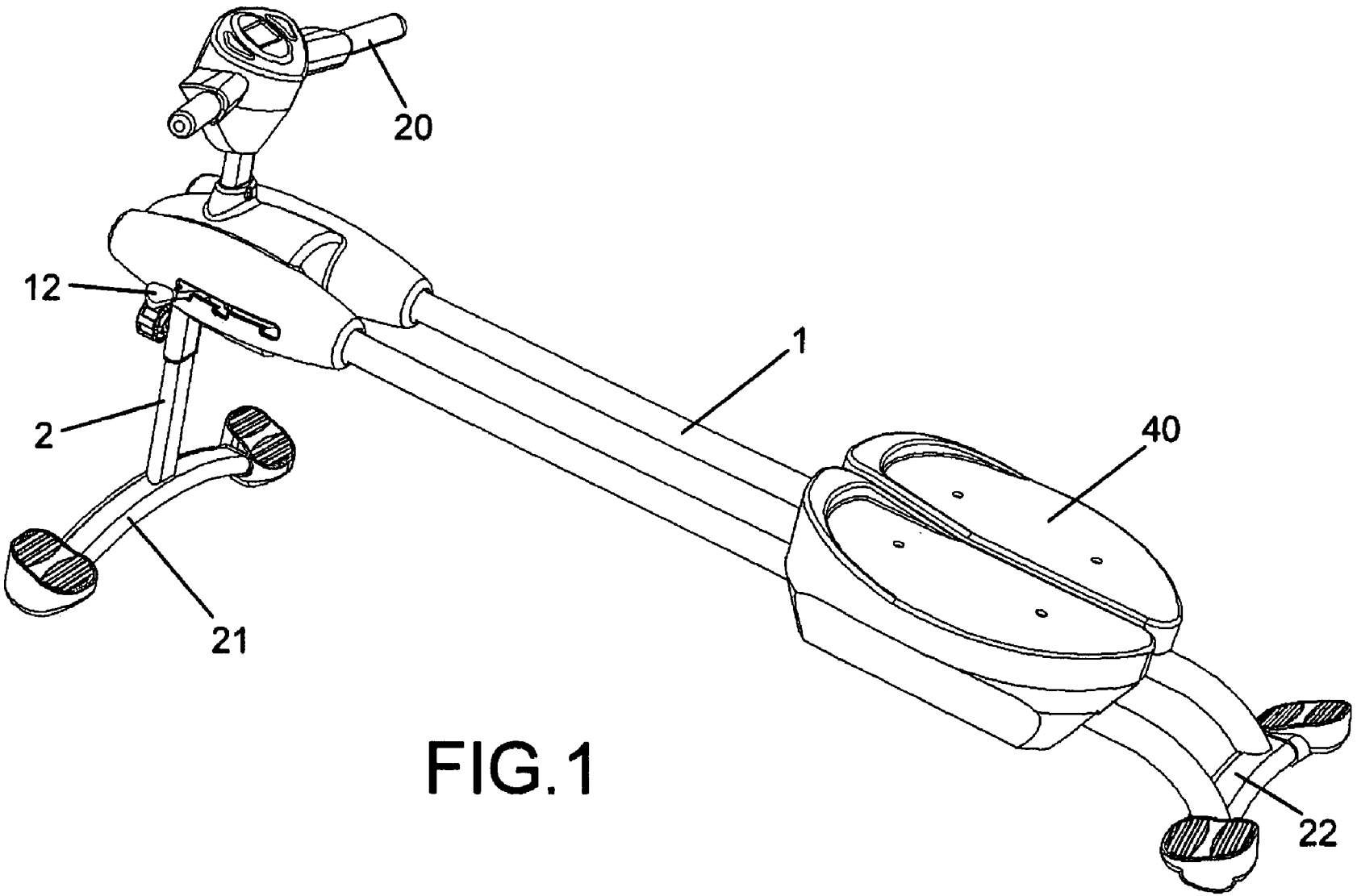
FIG. 1 is an elevational view of an exercising machine in accordance with the present invention.
Figure 2:
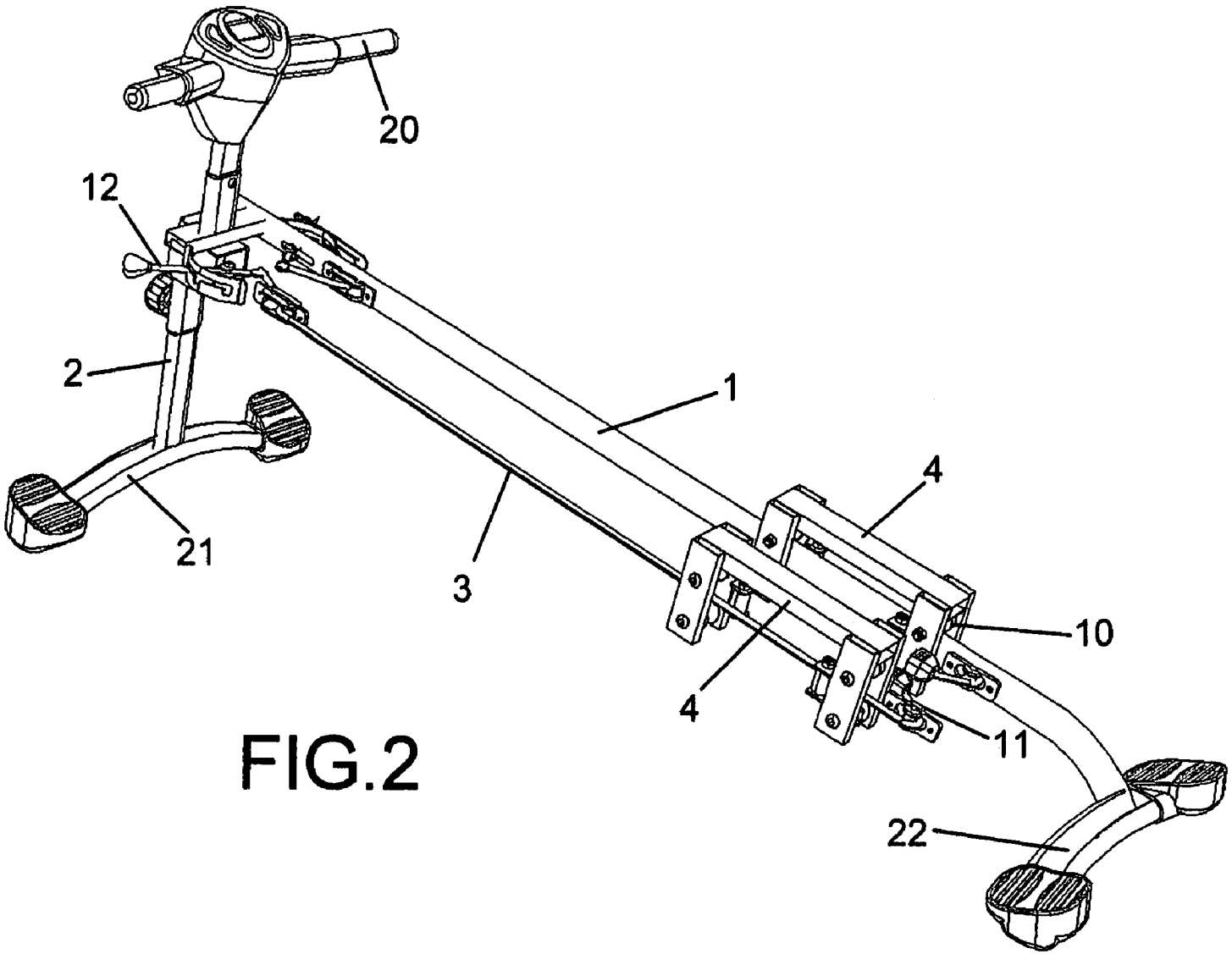
FIG. 2 is a cutaway view of the exercising machine according to the present invention.
Figure 3:
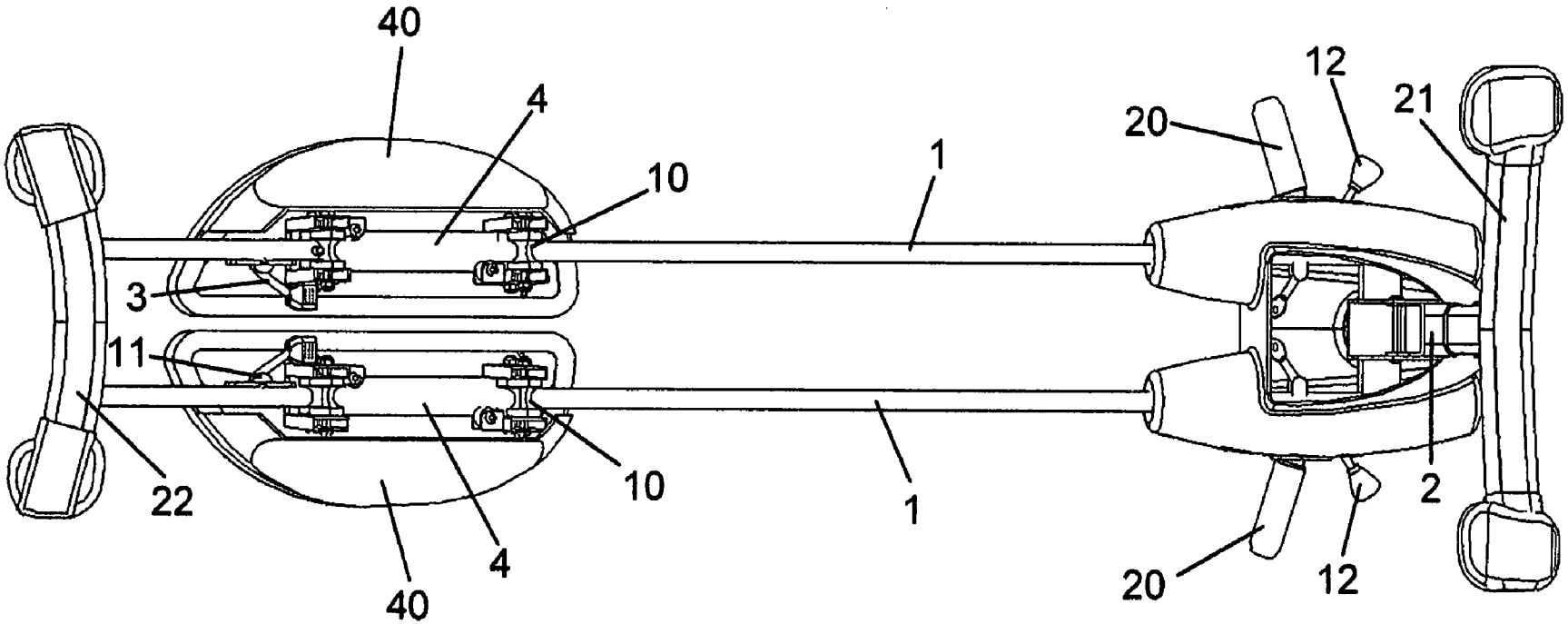
FIG. 3 is a bottom view of the exercising machine according to the present invention.

Referring to FIGS. 1-3, an exercising machine in accordance with the present invention is shown comprising a front foot member 21, a rear foot member 22, an upright 2 perpendicularly upwardly extended from the front foot member 21, a retractable handlebar 20 mounted in the upright 2, two sliding tubes 1 connected in parallel between the upright 2 and the rear foot member 22, two slide members 4 respectively coupled to the sliding tubes 1 by a respective set of sliding wheels 10 for movement along the sliding tubes 1, two footplates 40 respectively mounted on the slide members 4, two elastic pull straps 3 respectively inserted through the sliding tubes 1, roller 11, and respectively connected with the front and rear ends thereof to the slide members 4 and a respective tension adjuster 12 at the upright 2. Each slide member 4 has a plurality of elastic pull strap positioning means disposed at different locations for selectively securing the associating elastic pull strap 3.

Figure 4:
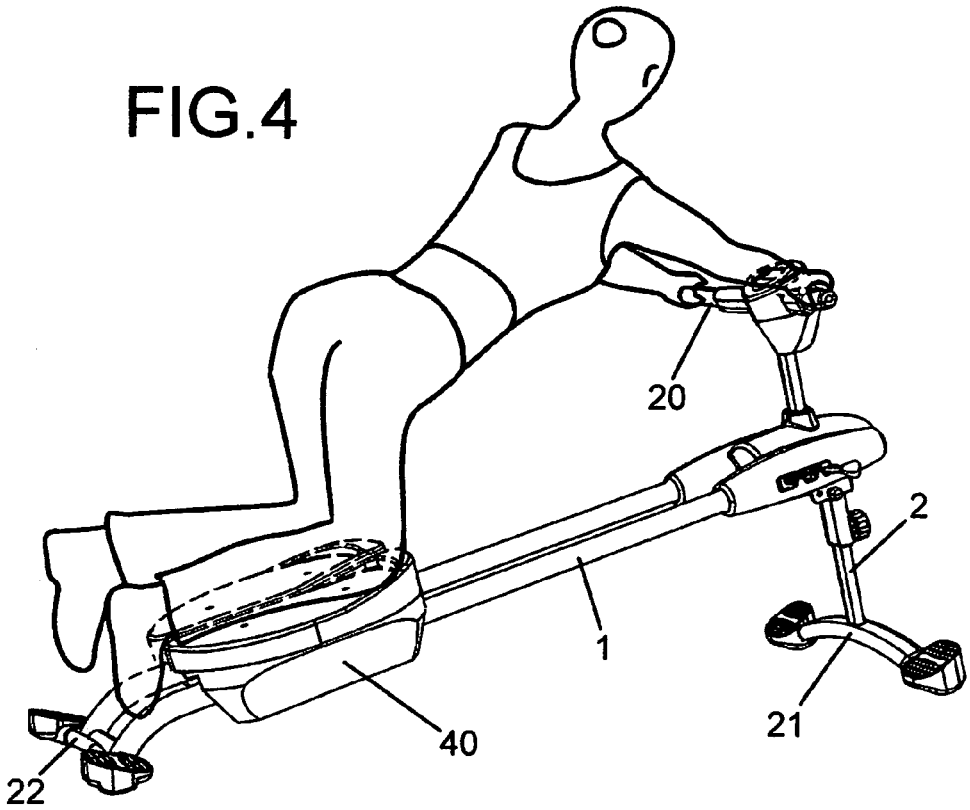
FIG. 4 is a schematic drawing show a first application example of the present invention (I).
Figure 5:
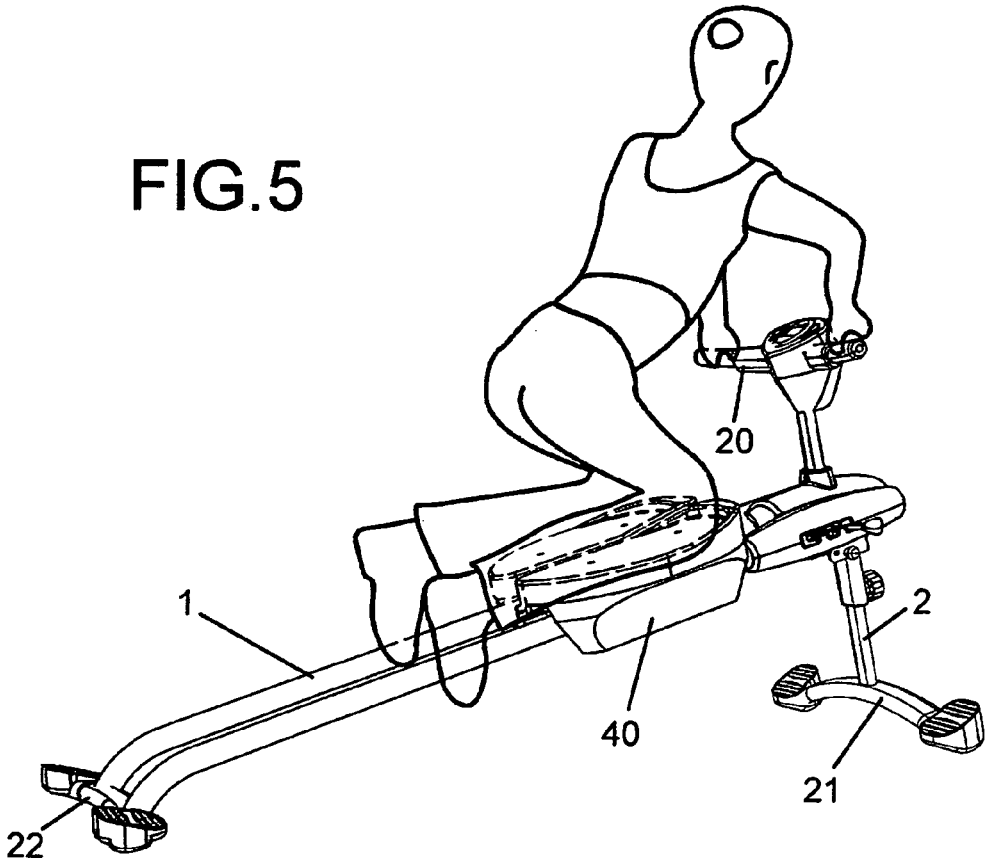
FIG. 5 is a schematic drawing show a first application example of the present invention (II).
Figure 6:
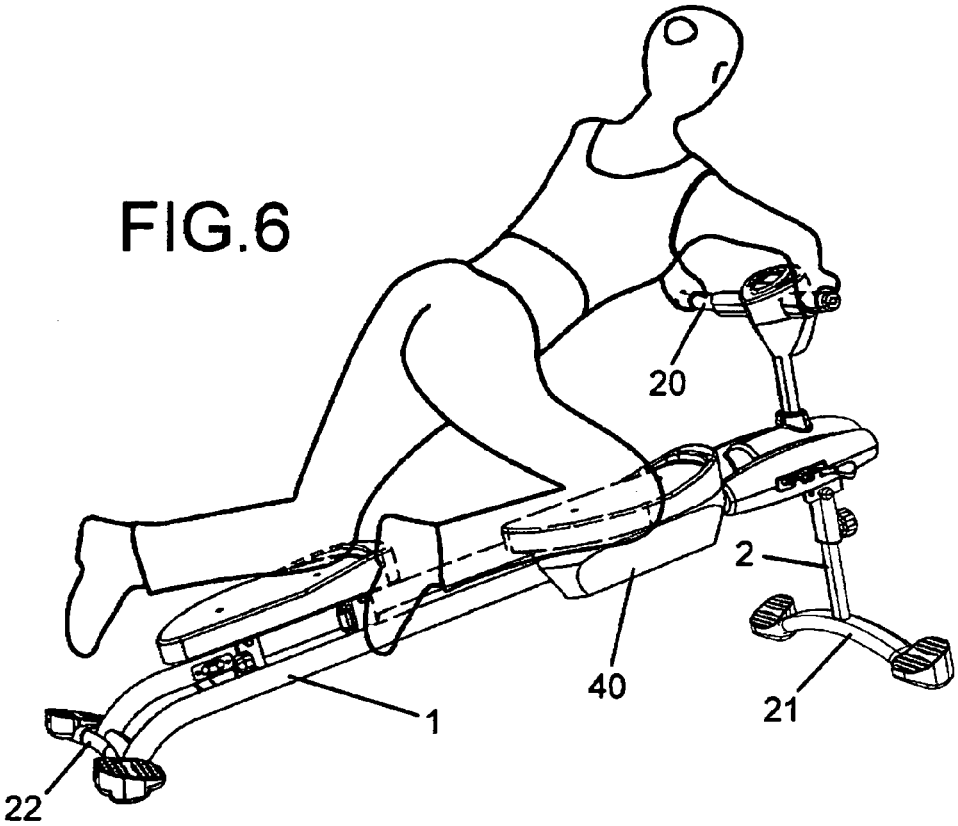
FIG. 6 is a schematic drawing show a second application example of the present invention (I).
Figure 7:
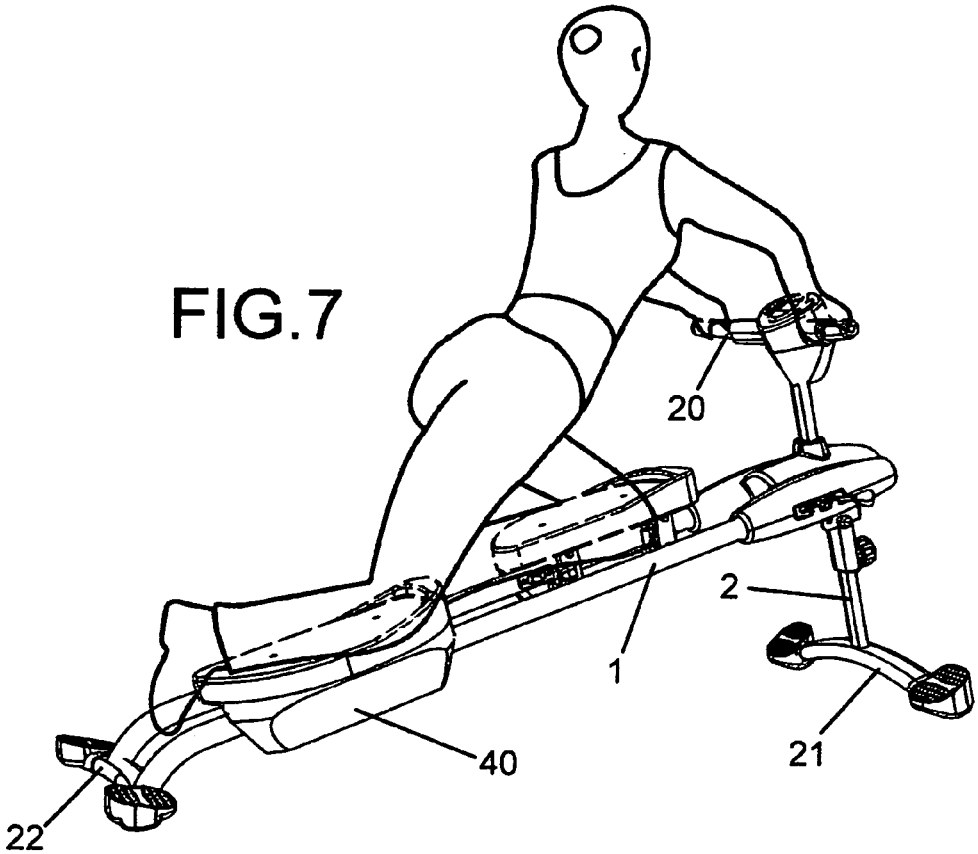
FIG. 7 is a schematic drawing show a second application example of the present invention (II).
Figure 8:
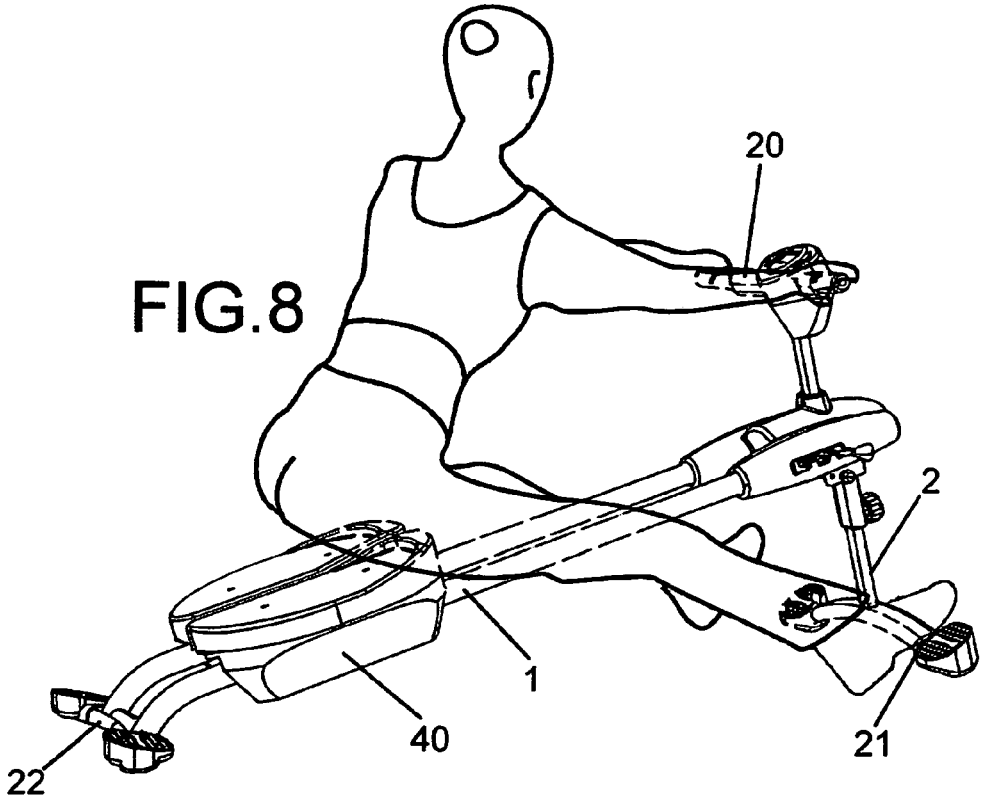
FIG. 8 is a schematic drawing show a third application example of the present invention (I).
Figure 9:
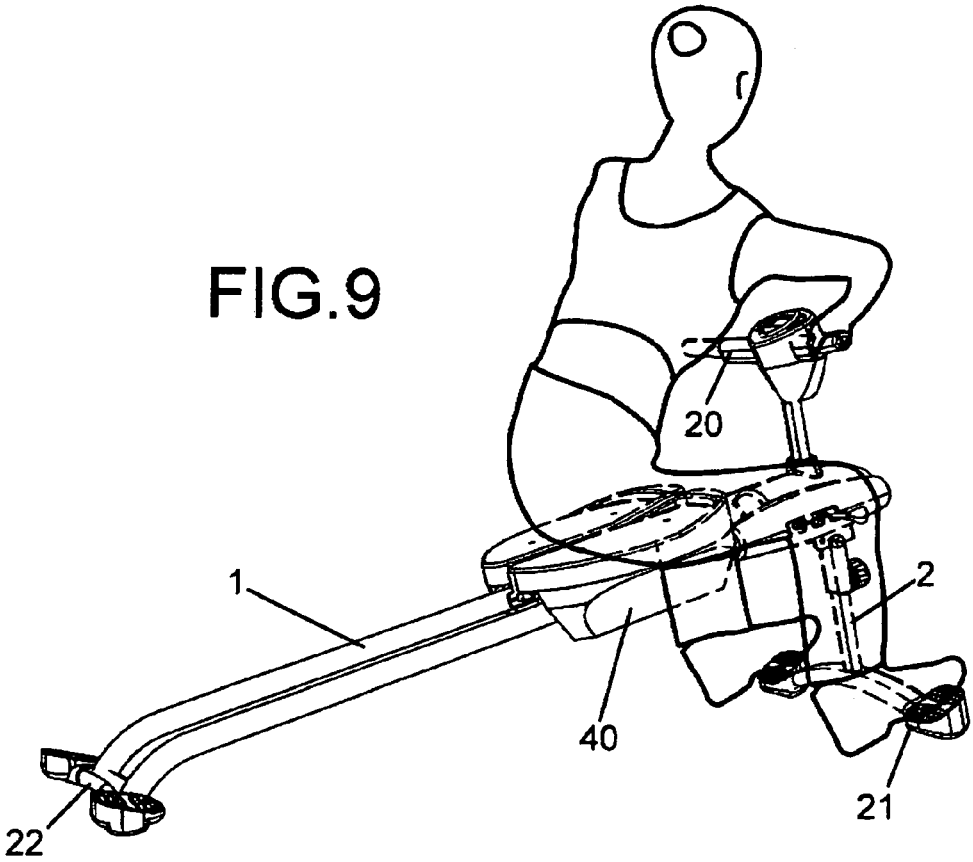
FIG. 9 is a schematic drawing show a third application example of the present invention (II).
Figure 10:
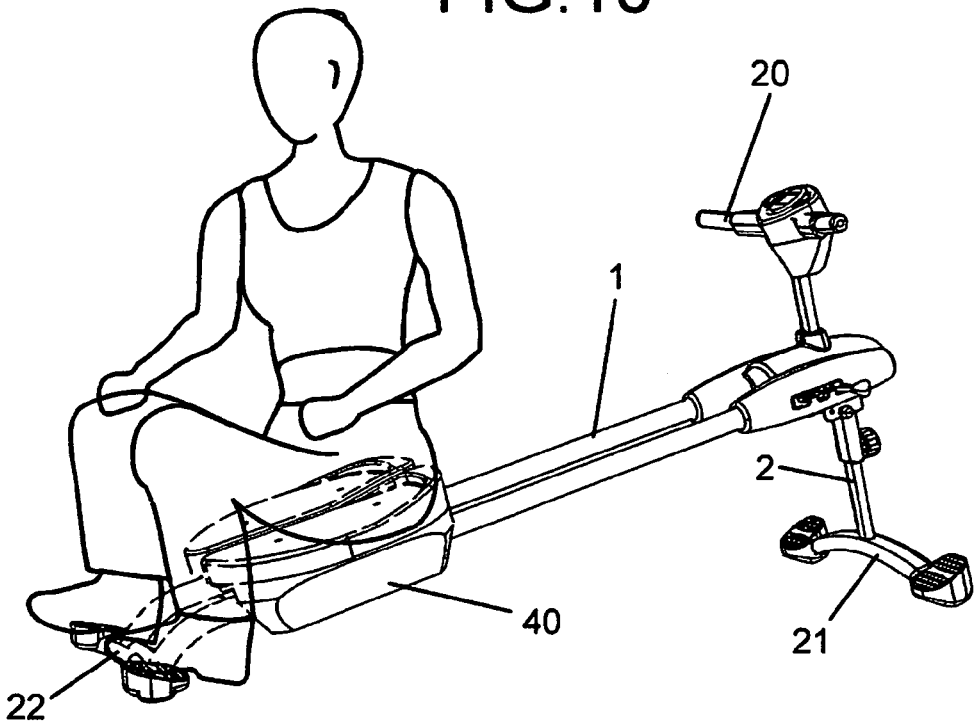
FIG. 10 is a schematic drawing show a fourth application example of the present invention (I).
Figure 11:
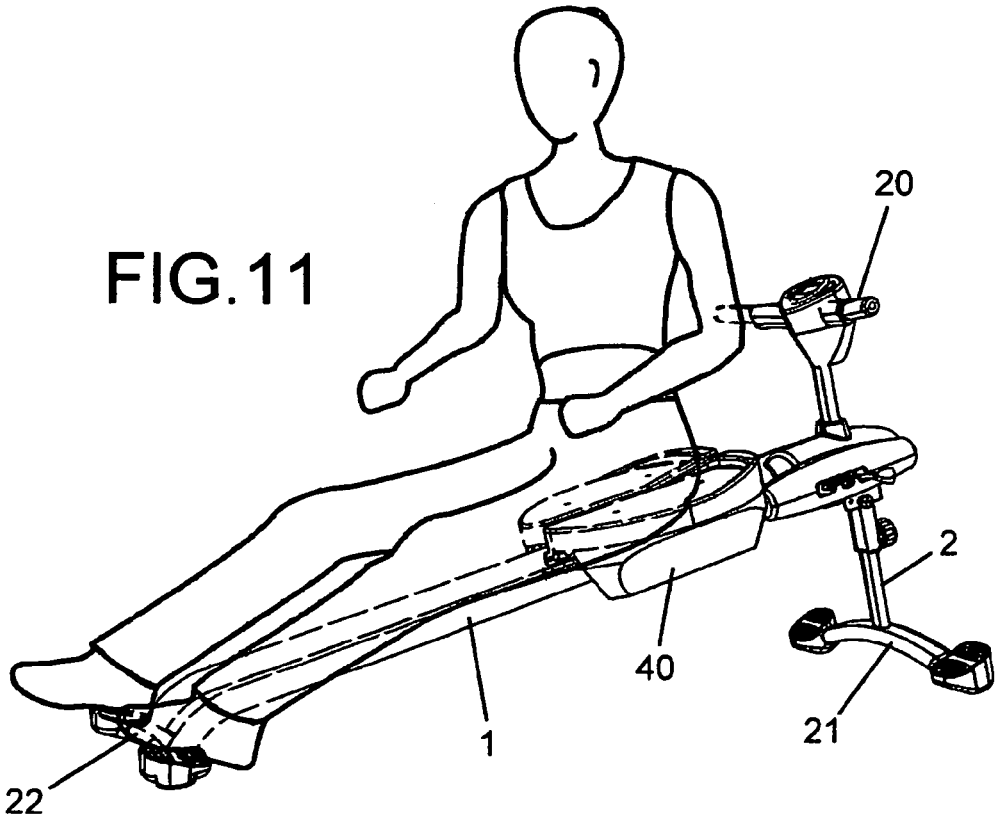
FIG. 11 is a schematic drawing show a fourth application example of the present invention (II).

When in use, the user can hold the handlebar 20 with the both hands and kneel on the footplates 40, and then alternatively push and pull the hands to move the footplates 40 along the sliding tubes 1 simultaneously with the two legs, as shown in FIGS. 4 and 5. The user can also hold the handlebar 20 with the both hands and kneel on the footplates 40, and then alternatively push and pull the hands to move the footplates 40 along the sliding tubes 1 alternatively back and forth with the two legs, as shown in FIGS. 6 and 7. The user can also sit on the footplates 40 and hold the handlebar 20 with the both hands and rest the two legs on the front foot member 21, and then push and pull the hands and the legs to move the footplates 40 back and forth along the sliding tubes 1, as shown in FIGS. 8 and 9. The user can also sit on the footplates 40 and hold the handlebar 20 with the both hands and rest the two legs on the rear foot member 22, and then push and pull the hands and the legs to move the footplates 40 back and forth along the sliding tubes 1, as shown in FIGS. 10 and 11.

Further, the user can operate the tension adjusters 12 or change the connection positions of the elastic pull straps 3 at the slide members 4, adjusting the tension of the elastic pull straps 3.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An exercising machine comprising:

a front foot member;

a rear foot member;

an upright perpendicularly upwardly extended from said front foot member;

a retractable handlebar mounted in said upright for the holding of the hands of a person using the exercising machine;

two sliding tubes connected in parallel between said upright and said rear foot member;

two slide members respectively coupled to said sliding tubes by a respective set of sliding wheels for movement along said sliding tubes;

two footplates respectively mounted on said slide members; and two elastic pull straps respectively inserted through said sliding tubes, each said elastic pull strap having one end thereof extended out of a front end of the associating sliding tube and connected to said upright and an opposite end thereof extended out of a rear end of the associating sliding tube and connected to one said slide member.

2. The exercising machine as claimed in claim 1, further comprising a tension adjuster means mounted at said upright and adapted to adjust the tension of said elastic pull straps.

* * * * *